United States Patent [19]

Hiramatsu et al.

[11] Patent Number: 4,655,882

[45] Date of Patent: Apr. 7, 1987

[54] PROCESS FOR MANUFACTURING ZINC-SILICA COMPOSITE PLATED STEEL

[75] Inventors: Minoru Hiramatsu, Kurashiki; Hitoshi Kawasaki, Kasaoka; Fumio Kusano, Okayama, all of Japan

[73] Assignee: Okayama-Ken, Okayama, Japan

[21] Appl. No.: 808,888

[22] Filed: Dec. 13, 1985

[30] Foreign Application Priority Data

Dec. 15, 1984 [JP] Japan ..... 59-264836

[51] Int. Cl.[4] ..... C25D 15/00

[52] U.S. Cl. ..... 204/16

[58] Field of Search ..... 204/16

[56] References Cited

U.S. PATENT DOCUMENTS 3,844,910 10/1974 Lipp et al. ..... 204/45
4,089,755 5/1978 Steinecker ..... 204/55
4,222,828 9/1980 Zuurdeeg ..... 204/16
4,444,630 4/1984 Steinecker ..... 204/55

*Primary Examiner*—T. M. Tufariello
*Attorney, Agent, or Firm*—Koda and Androlia

[57] ABSTRACT

A process for manufacturing zinc-silica composite plated steel performed by electrolyzation in a galvanization bath containing fine grains of silica, particularly colloidal silica fine particles. Surfactant having cationic property, such as polyoxyethylenelaurylamine or dodecyltrimethylammonium chloride is further added to the galavinization bath so that a zinc-silica layer is formed over the steel. The plated steel surfaces are further treated with a silane coupling agent, such as gamma-aminopropyltriethoxysilane. The steel plated with zinc-silica composite thus obtained has excellent resistance against corrosion and adhesion to organic paints or organic adhesives. The steel is suitable for various steel members and sheet iron for automobile bodies and parts which require high corrosion resistance.

5 Claims, No Drawings

PROCESS FOR MANUFACTURING ZINC-SILICA COMPOSITE PLATED STEEL

BACKGROUND OF THE INVENTION

1. Field of the Invention

The present invention relates to a process for manufacturing steel sheets or various types of steel members used as substrates for bonding (hereinafter, will be referred to as steel) which are treated with zinc-silica composite plating.

2. Prior Art

The process for galvanization has been used for ornamental plating of steel by aiming at beautification of appearance with emphasis focused on how to form the smooth surface.

In spite of the conventional background in the use of galvanization process mentioned above, recently, for example, for automobiles, with sophistication of products as well as expansion in geographical areas they are used in, the durability in terms of rust prevention became the requirement of them, and the galvanization has began to be applied also to the substrates for coating or rubber bonding.

However, in the case where the coating is applied onto the zinc plated steel or where the organic polymer materials (organopolymeric materials), such as rubber, are adhered onto the zinc plated steel, there has been the limit in improvement of adhesion no matter what arrangement is made for the composition of paint and the polymeric material, or even when the surface preparation agent, such as primer, adhesive, is provided between the steel and the paint.

Accordingly, various methods have been studied for treating the surface of the steel which has been galvanized (zinc plated) in order to prepare the steel surface for bonding, and such methods have been put in practical use. Those methods include (1) chemical treatments, such as chemical conversion process for forming the phosphate film through phosphate coating, or chemical conversion process for forming the chromate film through chromic acid coating; and (2) physical treatments to obtain the wedge (anchoring) effect through giving the irregularity to the surface of steel plate by means of sand blasting, grit blasting, etc. In other words, unlike the conventional purpose of galvanization, that is to provide the zinc plate surface with smoothness, the purpose of the method mentioned above is to make the surface as rough as possible.

The method using the phosphate mentioned in (1) is most widely used as the treatment process for the steel surface after the galvanization. However, it has the problems in the treatment of the waste water and the disposal of large amounts of sludge. Also, the treatment with chromic acid does not always give the satisfactory effect of adhesion needed as substrate coating. Besides, it has the problems of toxicity of chromium and the waste water treatment.

The physical process using the sand blasting, etc. that is mentioned in (2) also is not free of difficulties. That is, it is hard to provide the plate with irregularity that is sufficiently fine and complex to fully show the anchoring effect. Furthermore, such methods are not suitable for bent shape and small members. In addition, the irregularity cannot be provided for all the corners of the member.

It is mentioned in U.S. Pat. No. 4,089,755 and U.S. Pat. No. 4,444,630 that the alkyl-substituted (alkylated) ammonium salt is added as migration agent in the zinc plating bath in order to polish the zinc plate. Also, U.S. Pat. Nos. 3,844,910 and 4,222,828 disclose the process for forming the coprecipitation deposit with metal through suspending inorganic grains in metal plating bath as a method for providing the surface of the plate with roughness, sliding capacity, wear resistance and corrosion stability.

However, the U.S. Pat. Nos. 4,089,755 and the 4,444,630 are different from the present invention in purpose. The patents disclose alkyl-substituted ammonium salt, and the purposes are to effect the polishing of the zinc plate surface. However, use of the coprecipitation system with the silica fine grains is not disclosed.

The object of the present invention is rather contrary to that aimed at by the foregoing prior art. That is, what is intended by the present invention is to eliminate the smoothness of the plate surface and thus to bring about the anchoring effect on the paint and adhesive even without giving the after-treatment, through the electrolyzation carried out by adding the cationic surface active agent into the zinc-silica composite plating system.

In the process for manufacturing metal coating products provided by the U.S. Pat. No. 3,844,910,for the Ni plating, gamma-amino-propyltriethoxysilane is added for the coprecipitation with SiC presenting as nonmetallic particles. In this manufacturing process, a similar substance to the silane coupling agent used in the present invention is used as the dispersant for SiC.

Similar to U.S. Pat. Nos. 3,844,910, 4,222,828 uses the Ni-plate as primary body. In this invention, in order to improve the coprecipitation state in the Ni-SiC composite plating, the electrolyzation is performed by using the cationic fluorocarbon activator and $KNO_3$ at the Zeta potential of at least +40 mV. In U.S. Pat. No. 4,222,828 as the object of the metallic plating, Zn is disclosed. Also, as the nonmetallic grains for coprecipitation, $SiO_2$ is described. However, they are merely listed with no detailed description given on the conditions of the electrolyzation. Further the invention does not intend to obtain the substrate steel sheet that is satisfactory in adhesion to the adhesive agent and the primer of paint, as intended by the present invention.

SUMMARY OF THE INVENTION

Therefore the object of the present invention is to provide a process for manufacturing a new zinc-silica composite plated steel (a steel plated with zinc-silica composite), wherein the conentional treatment for the surface of galvanization steel can be omitted.

The present invention was achieved based upon a finding that the treatment of the steel with a specific zinc-silica composite plating solves the drawbacks of the prior art. The invention is made after various studies conducted for zinc platings (galvanization) which gives desirable adhesion for the bonding of the organic polymer materials, such as rubber, as well as for the application of coatings.

The features of the present invention are (1) an electrolyzation is performed to steel in galvanization bath partly containing silica fine grains; (2) for the electrolyzation process, silica particulates and cationic surfactant are added in the galvanization bath; and (3) following these processes, silane coupling treatment is given to the steel by using silane coupling agent.

Particularly, by conducting the zinc-silica composite plating (1) no matter how smooth the plated surface is, the plating itself provides a rustproof effect that is superior to that shown by conventional plating. In the second place, when a specified surfactant is added (2), the surface smoothness is lost, and the anchoring effect is obtained without conducting an after-treatment. Then in the third place, by treating the surface with the silane coupling agent (3), extremely desirable rust resistance is obtained without applying the coating.

DETAILED DESCRIPTION OF THE INVENTION

The silica in superfine form provides the most preferable results. Such silica is generally called colloidal silica. Vitaseal #1500 that will be mentioned in the Examples described later is 18 mμ in its mean grain diameter, and it is as fine as it can float in the air. Needless to say, however, if the silica is 1 to several microns or less, the zinc-silica composite plating can be performed.

Cationic surface active agents which provide a desirable result include polyoxyethylenelaurylamine and dodecyltrimethylammonium chloride.

Silane coupling agent is originally used as surface preparation agent for the silica powder as the filler of rubber and plastics. The inventors believe the present invention is the first that uses silane coupling agent for the surface treatment of steel plated with zinc-silica composite.

Silane coupling agent may be selected from the compounds listed below, depending upon the use and purpose.

As the silane coupling agent, most of the alkoxysilane compounds may be used such as: vinyltriethoxysilane, vinyl tris (beta-methoxy-ethoxy) silane, beta-(3,4-epoxycyclohexyl)-ethyltrimethoxysilane, gamma-glycidoxypropyltrimethoxysilane, gamma-methacryloxypropyltrimethoxysilane, N-beta (amminoethylgamma-aminopropyltrimethoxysilane, N-beta (aminoethyl)-gamma-aminopropyl-methyldimethoxysilane, gamma-aminopropyltrimethoxysilane, gamma-chloropropyltrimethoxysilane, gamma-mercaptopropyltrimethooxysilane. Of those mentioned above, the alkoxysilanes including methyltrimethoxysilane, ethyltriethoxysilane, N-octyltriethoxysilane, and octadecyltriethoxysilane which are highly hydrophobic and quite preferable for the use without coating the surface.

Silane coupling agents give the desirable result when used according to the polymeric materials subjected to the adhesion to steel. For example, for the epoxy system, melamine system and phenol system resins, gamma-aminopropyltriethoxysilane and beta-(3,4-epoxycyclohexyl)-ethyltrimethoxysilane are suitable. Also, for the unsaturated polyester system and polyethylene resins, vinyltriethoxysilane and gamma-methacryloxypropyltrimethoxysilane can be used. Furthermore, for urethane and SBR, as well as natural rubber, etc., gamma-mercaptopropyltrimethoxysilane, etc. can be used as adequate selections.

Silane coupling treatment to the steel plated with zinc-silica composite carried out by dipping the steel in diluted solution of water methanol, etc. or in the stock solution of silane coupling agent. The treatment can also be performed by coating or spraying the solution on the steel surface. Then, the steel is dried at 80°–140° C. for a specified time for finishing.

According to the present invention, the silica grains are contained on the surface of the steel by the zinc-silica composite plating regardless of the degree of smoothness of the plated surface. Thus, rust can be prevented. Also, since the zinc-silica composite plating is performed in the presence of the cationic surface active agent, the smoothness of the surface is lost due to the effect of the addition of the foregoing surface active agent. As a result, the anchoring effect is obtained without requiring after-treatment. Furthermore, by performing the silane coupling treatment, the silane coupling agent is interposed between the galvanized surface and the polymeric material resulting in improved adhesion.

In other words, the zinc-silica composite plated steel, which is obtained by the electrolyzation conducted in the zinc plating bath or galvanization bath with fine grains of silica and the cationic surface active agent added, contains fan-shaped zinc projections which have the anchoring effect and are formed densely over the surface of the zinc-silica composite plated steel. In addition, between those projections and over their surfaces, a silica film that is highly adhesive in bonding to the polymeric material is formed densely. Moreover, when the surface of the steel is further treated with silane coupling, the steel has a strong adhesion to the organic polymer materials, such as rubber, plastics, as well as paints.

A detailed description of the present invention will be provided below with reference to the actual examples.

EXAMPLE 1

The composition of the plating bath was set to be (pH 4):

| | |
|---|---|
| $ZnSO_4\ 7H_2O$ | 288 g/l |
| $H_3BO_3$ | 25 g/l |
| $NH_4Cl$ | 27 g/l |

and 50 g/l of fine grains of silica with the grain diameter of 18 mμ (Vitaseal #1500 from Taki Seihi Co., Ltd.) was added to the plating bath. While stirring the mixture thus obtained the plating was carried out for 18 minutes at 25° C. in liquid temperature and at 2 A/dm$^2$ in current density, using a zinc plate (99.99%) as positive electrode (anode) and a 0.5 mm thick steel plate (60×70 mm), that has been degreased in advance with alkali, as the negative electrode (cathode).

The zinc-silica composite plated steel resulting from the plating performed as mentioned above was 9 μm thick, with 0.68 wt.% of silica contained in the film of zinc plate. The composite plate thus obtained has highly strong adhesion to the organic polymer materials, as seen in Table 1 and desirable corrosion resistance as seen in Table 2.

EXAMPLE 2

The plating bath was prepared by setting its composition to be:

| | |
|---|---|
| ZnO | 13 g/l |
| NaOH | 110 g/l |

and by adding 6 ml/l of the brightening agent (NZ-60S from Dipsole Co., Ltd.) as addition agent additive. Into the plating bath, 50 g/l of the fine grains of silica of 18 mμ in grain diameter (Vitaseal #1500 from Taki Seihi Co., Ltd.) was added. Then while stirring the mixture thus obtained the plating treatment was carried out for 18 minutes at 20° C. in liquid temperature and at 2 A/dm$^2$ in current density, by using a zinc plate (99.99%) as anode while using a 0.5 mm thick steel plate (60×70 mm) as cathode. Alkali degreasing treatment was previously conducted on this cathode steel plate.

As a result, the zinc-silica composite plated steel of 9 μm in plate thickness with 0.13 wt.% of silica contained in the zinc plate film was obtained. The composite plate thus obtained is highly strong in adhesion to the organic polymer material, as seen in Table 2 and also is satisfactory in corrosion resistance as shown in Table 2.

EXAMPLE 3

The plating bath was prepared by the same method as Example 1, and the additives with the concentrations shown below were added to the plating bath:

Nonionic active agent (polyoxyethylenelaurylamine): $5\times10^{-3}$ ml/l

Cationic active agent (dodecyltrimethylammonium chloride): $5\times10^{-4}$ M/l

The plating bath mentioned above is 4 in pH. In this state, by using a zinc plate (99.99%) as anode, while using a 0.5 mm thick steel plate (60×70 mm), that was treated in advance with degreasing with trichloriethylene, as cathode, the plating was carried out at 30±2° C. in liquid temperature and at 2 A/dm$^2$ in current density, for 18 minutes.

The galvanized steel thus obtained is 9 μm in average plate thickness. Over the surface of this galvanized steel fan-shaped zinc projections are densely formed. The height of the projections are 5-10 μm, and between those projections, 1.8 wt.% of fine grain silica was dispersed.

Such steel plated with zinc-silica composite has highly strong adhesion to organopolymetric material, as shown in Table 1 and desirable corrosion resistance as seen in Table 2.

EXAMPLE 4

Into the plating bath same as that in the previous example, polyoxypropyleneglycol ethyle oxide ("Pruronic" in trade name) in the amount of $10^{-1}$ ml/l was added as the nonionic active agent. Also, as the cationic active agent, $10^{-3}$ M/l of dodecyldimethylbenzylammonium chloride was added. Then, by using the zinc plate as positive electrode while using the preliminarily degreased external cylinder for automobile suspension bush that is 4 mm thick and 80 mm ϕ×90 mm in length as the negative electrode, the plating was performed for 18 minutes at 25° C. in liquid temperature and at 2 A/dm$^2$ in current density.

As a result, the microscopy of the external cylinder of steel showed that the outer circumferential surface and the inner circumferential surface of this steel cylinder are plated with zinc-silica composite, with an abundance of fine irregularities formed over them, the same as those found in the samples obtained in Example 2.

The deposits formed by composite plating has innumerable fine particles of silica dispersed homogenously in the zinc plate layer, and it is high in mechanical strength. Therefore, when the paint (coating) or other organic polymer material is adhered to such irregular surface, a part of such paint or other organic polymer material enters the holes formed in the irregular portions or the bridged portions, then solidified, thereby bringing about the state of strong adhesion. Such result is derived from the highly complicated plate surface which was not obtained by the conventional mechanical treatment using sand blasting or by the existing chemical treatment which uses phosphate salt, etc.

EXAMPLES 5-7

The zinc-silica composite plated steel obtained by the method used in Example 3 mentioned above was dried at 105° C. for one hour. Thereafter, as the silane coupling agent, gamma-aminopropyltriethoxysilane (Example 5), gamma-methacryloxypropyltrimethoxysilane (Example 6) and gamma-mercaptopropyltrimethoxysilane (Example 7) were placed in separate containers, in the amount of 3 parts each, respectively. Then, 3 parts of water and 94 parts of methanol were added in each of the foregoing containers in order to prepare the three types of treatment solutions. The sample zinc-silica composite plated steel material was immersed in each treatment solution for one hour. After the immersion, the respective samples were dried at 120° C. for two hours. Thus, three types of zinc-silica composite plated steel samples treated with respectively different silane coupling agents were obtained.

These steel samples plated with zinc-silica plating and treated with silane coupled thus prepared have highly strong adhesion to the organic polymer material, as seen in Table 1, and extremely satisfactory corrosion resistance as seen in Table 2.

The present invention is not limited to the examples described above, and for the plating bath, the other components or additives may be used. For example, the plating bath may include other zinc compounds which are usually applicable to such bath. Also, the other plating assistant may be added. Besides, as the fine grains of silica, those which are several μ or smaller in size may be used. As the active agent, other anionic active agents containing the polyoxyethylene groups, as well as the other cationic active agents or quaternary ammonium salts, etc., may also be used. In such case, for the pH of the plating bath, the acidic range is preferable.

As the silane coupling agent, those containing various types of alkoxy groups as mentioned previously may be used.

As to the amount of the surface active agent added, preferable result was obtained when, for example, $10^{-3}$–$10^{-1}$ ml/l of polyoxyethylenelaurylamine was added as the nonionic active agent, and when $10^{-5}$–$10^{-3}$ M/l of dodecyltrimethylammonium chloride was added as the cationic active agent.

The silane coupling agent that gave the desirable result was gamma-aminopropyltriethoxysline. When it is particularly intended to obtain water repellency for the uncoated member, good results can be obtained through the use of silane coupling agents selected from the previously mentioned water repellent silane coupling agents.

The appropriate plating conditions are 20°–40° C. in bath temperature and 0.05–5 A/dm$^2$ in current density.

When the zinc-silica composite plated steel obtained by using the process provided by the present invention was coated directly with the paint without giving the substrate (surface preparation) treatment, satisfactory results as shown in Table 1 which have never been obtained in the prior art were obtained in the adhesion test. The adhesion test was conducted in accordance with the Erichsen test as will be mentioned later.

As the paint (coating material), the melamine system paint (2B-Amilac Black from Kansai Paint Co., Ltd.) was used. The coating was carried out to form the coating film of 20 μm in thickness, and then, the film was dried by baking at 140° C. for 25 minutes.

Of the Comparison Examples shown in the Tables, Comparison Example 1 was obtained through the electrolyzation carried out by eliminating the fine grains of silica from the plating bath in Example 1. Comparison Example 2 was prepared through treating the surface of the galvanized steel obtained in Comparison Example 1 with phosphate. For the treatment with phosphate, the zinc phosphate treatment solution (BT-7R from Nippon Parker Co., Ltd.) was used, and by the immersion at 50° C. in liquid temperature for two minutes and 20 seconds, 2.2 g/m$^2$ zinc phosphate film was formed over the galvanized plate surface.

TABLE 1

| Test Item<br>Test Samples | Film Adhesion<br>(Erichsen Test) |
|---|---|
| Example | |
| 1 | |
| 2 | |
| 3 | |
| 4 | |
| 5 | |
| 6 | |
| 7 | |
| Comparison Example | |
| 1 | X |
| 2 | |

The adhesion test was carried out in accordance with the Erichsen test method in JIS-Z-2247 (10 mm in extrusion output). The criteria for evaluation were as shown below.

: No peeling occurred
: Slightly peeled
X: Peeled quite extensively

As shoud be apparent from the results shown in Table 1, because of the highly strong adhesion between the paint and the steel, the paint is hardly flawed (scratched), and does not peel off for a long period of time.

Next, the salt spray test according to JIS-Z-2371 for checking the corrosion resistance was conducted, and the results are shown in Table 2.

TABLE 2

| Test Items<br>Test Samples | Corrosion Resistance<br>(Salt Spray Time Until Formation of Red Rust) |
|---|---|
| Example | |
| 1 | 360 (hr) |
| 2 | 240 |
| 3 | 750 |
| 4 | 750 |
| 5 | 2700 |
| 6 | 2700 |
| 7 | 2700 |
| Comparison Example | |
| 1 | 72–96 |
| 2 | 72–96 |

As described above, according to the present invention, the zinc-silica composite plated steel used as substrate for adhesion can be obtained by the plating process alone which has been ordinarily carried out. The zinc-silica composite plated steel obtained by the process of the present invention is itself capable of resisting corrosion. Besides, it has the highly strong adhesion to paint or the other polymeric materials without having to be treated by the mechanical process, such as sand blasting, or by the chemical process using phosphates, etc. Accordingly, the members which are processed with surface coating or adhered, can strongly resist peeling. Also, the outstanding effect of rust prevention is obtained. Consequently, such zinc-silica composite plated steel is effective in use for automobile parts, etc. in places where severe environment in terms of corrosion due to the use of rock salt, etc. and antifreezing agent during the winter season or in the regions where the weather is severly cold.

We claim:

1. A process for manufacturing zinc-silica composite plated steel, wherein, upon the galvanization of steel, an electrolyzation is performed in a galvanization bath into which is added fine grains of silica and cationic surface active agent having cationic property, then, a coupling treatment is carried out through the use of silane coupling agent, whereby plated steel with a rough surface suitable for bonding coatings thereto is provided.

2. A process for manufacturing zinc-silica composite plated steel according to claim 1, wherein the cationic surface active agent is an amine system nonionic surface active agent, in acidic solution, having cationic property.

3. A process for manufacturing zinc-silica composite plated steel according to claim 2, wherein the amine system nonionic surface active agent is polyoxyethylenealkylamine.

4. A process for manufacturing zinc-silica composite plated steel according to claim 1, wherein the surface active agent having the cationic property is a cationic surface active agent.

5. A process for manufacturing zinc-silica composite plated steel according to claim 4, wherein the cationic surface active agent is an aliphatic quaternary ammonium salt.

* * * * *